United States Patent [19]

Nakahama

[11] Patent Number: 4,631,035

[45] Date of Patent: Dec. 23, 1986

[54] HYDRAULIC TILT DEVICE FOR MARINE PROPULSION UNIT

[75] Inventor: Ryoji Nakahama, Iwata, Japan

[73] Assignee: Sanshin Kogyo Kabushiki Kaisha, Shizuoka, Japan

[21] Appl. No.: 704,708

[22] Filed: Feb. 22, 1985

[30] Foreign Application Priority Data

Feb. 23, 1984 [JP] Japan ..... 59-31416

[51] Int. Cl.[4] ..... B63H 5/12

[52] U.S. Cl. ..... 440/61

[58] Field of Search ..... 440/56,58-63, 440/65, 53; 91/420

[56] References Cited

U.S. PATENT DOCUMENTS 4,064,824 12/1977 Hall et al. ..... 440/61

4,395,239 7/1983 Hall et al. ..... 440/61

*Primary Examiner*—Sherman D. Basinger

*Assistant Examiner*—Jesûs D. Sotelo

*Attorney, Agent, or Firm*—Ernest A. Beutler

[57] ABSTRACT

A number of embodiments of hydraulic tilt and trim units for marine outboard drives. The devices employ a reversible fluid pump that drives a double acting cylinder to effect pivotal movement of the outboard drive between a tilted up and a tilted down position. The circuitry of the connection between the fluid pump and motor is such that the displaced fluid from the fluid motor need not flow through the pump during tilt down operation so that tilt down operation can be accomplished at a greater rate of speed than tilt up operation.

17 Claims, 9 Drawing Figures

HYDRAULIC TILT DEVICE FOR MARINE PROPULSION UNIT

BACKGROUND OF THE INVENTION

This invention relates to a hydraulic tilt device for a marine propulsion unit and more particularly to an improved hydraulic arrangement for such a device that permits more rapid operation than was possible with prior art devices.

In most hydraulically operated tilt and trim units for marine outboard drives, at least one double acting fluid motor is provided for powering the outboard drive between its tilted up and its tilted down positions. This hydraulic mortor is operated by means of a reversible fluid pump that selectively supplies fluid under pressure to one side of the fluid motor and vents the other side back to the port of the fluid pump that is acting as the suction port. Although fast operation is always desirable, there is a practical limit to the speed at which the outboard drive can be tilted up. If the outboard drive is tilted up too rapidly, the reactive force on the associated watercraft tends to cause its bow to rise and too rapid an elevation can result in a dangerous situation. As a result, the hydraulic circuitry and the output of the fluid pump is governed so as to restrict the rate of elevation to about 2° of tilting per second.

With the hydraulic systems of the type previously proposed, however, all of the fluid that is displaced from the non-pressurized side of the fluid motor is returned back to the pump circuit through the port of the fluid pump that is acting as the suction port. Thus, if the system is designed so as to limit the rate at which the outboard drive may be tilted up, the tilting down rate is also so controlled. However, the reasons which make it desirable to limit the tilting up speed of the outboard drive do not apply equally to tilting down operation. In fact, there are many instances when it is desirable from a safety and operational standpoint to effect tilting down at a much more rapid rate than tilting up. For the reasons noted above, however, the prior art systems have not permitted such rapid titlting down operation.

It is, therefore, a principal object of this invention to provide an improved hydraulic tilt and trim unit for a marine outboard drive.

It is a further object of this invention to provide a marine outboard drive hydraulically operated tilt and trim unit that permits more rapid ilting down operation than tilting up operation.

It is yet a further object of this invention to provide a hydraulic tilt and trim unit for a marine outboard drive in which the return fluid from the hydraulic tilt cylinder need not pass through the suction side of the powering fluid pump.

SUMMARY OF THE INVENTION

The invention is adapted to be used in a hydraulic tilt and trim unit for a marine outboard drive that is pivotal about a generally horizontal axis between a tilted up position and a tilted down position. A double acting fluid motor is operatively connected between the outboard drive and the associated watercraft for pivotal movement of the outboard dirve about the horizontal axis upon operation of the fluid motor. A reversible fluid pump has a first port that is operative as a suction port when the fluid pump is operated in a forward direction and as a pressure port when the fluid pump is operated in the reverse direction and a second port which is operative as a pressure port when the fluid pump is operated in the forward direction and as a suction pump when the fluid pump is operated in the reverse direction. Conduit means are provided for delivering fluid from the first port to drive the fluid motor in a raising direction when the fluid pump is operated in its reverse direction for effecting pivotal movement of the outboard drive toward its tilted up position and for delivering fluid from its second port when the fluid pump is operated in its forward direction to drive the fluid motor in its lowering direction for effecting pivotal movement of the outboard drive toward its tilted down position. In accordance with the invention, means are provided for discharging fluid from the fluid motor when the outboard drive is being tilted down independently of the first fluid motor port.

DETAILED DESCRIPTION OF THE PREFERRED EMBODIMENTS

The Environment

Figure 1:
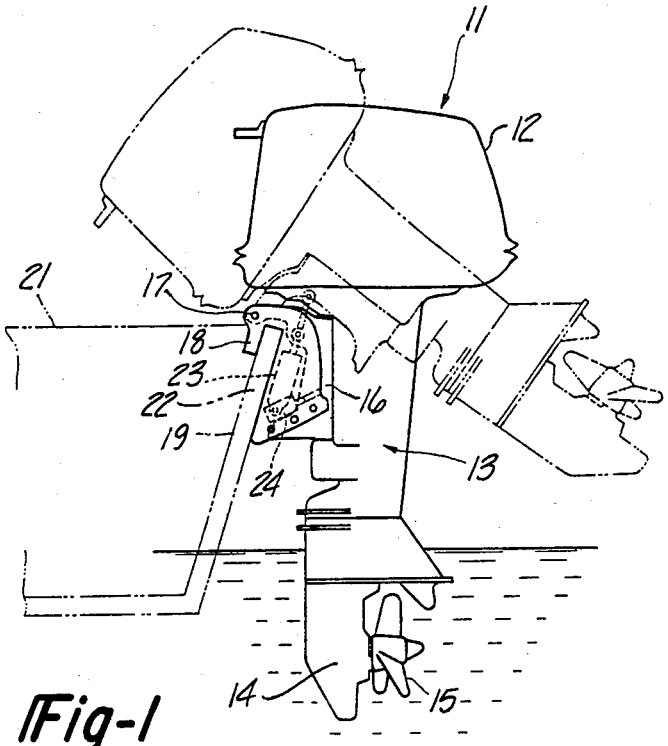
FIG. 1 is a side elevational view of an outboard motor attached to the transom of an associated watercraft and embodying a hydraulic tilt and trim unit. The solid line view shows the outboard motor in a tilted down position while the phantom line shows the outboard motor in the tilted up condition.
Figure 2:
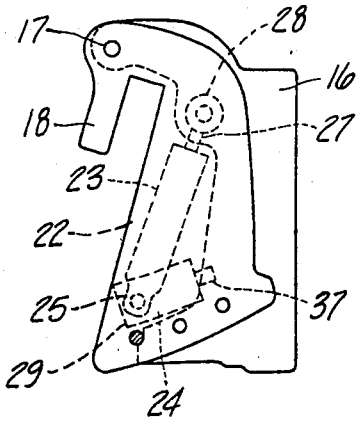
FIG. 2 is an enlarged side elevational view showing the connection of the hydraulic tilt and trim cylinders to the associated components.

The invention is adapted to be embodied in tilt and trim units as applied to marine outboard drives and FIGS. 1 and 2 show generally the construction of the outboard drive and the hydraulic tilt and trim arrangement associated with it. An outboard motor having a tilt and trim unit constructed in accordance with the invention is identified generally by the reference numeral 11. Although the invention is described in conjunction with an outboard motor, it can be equally as well practiced in connection with out outboard drive portion of an inboard-outboard arrangement. The application of the invention to such an outboard drive of an inboard-outboard unit is believed to be readily obvious to those skilled in the art.

The outboard motor 11 includes a power head 12 in which an internal combustion engine is positioned. The engine drives a drive shaft that is rotatably journaled in a drive shaft housing 13 and which terminates in a lower unit 14 in a known manner. The drive shaft drives a propulsion device carried by the lower unit 14, in this case a propeller 15, in a known manner.

The drive shaft housing 13 is supported for steering movement about a vertically extending axis by means of a swivel bracket 16. The swivel barck 16 is, in turn, supported for pivotal movement about a horizontally extending axis by means of a pivot pin 17 and clamping bracket 18. As is well known, the clamping bracket 18 permits attachment of the motor 11 to a transom 19 of a watercraft 21 (shown in phantom). The construction of the clamping bracket 18, swivel bracket 16 and the steering and tilting construction of the motor 11 are not described in any more detail because this portion of the construction is conventional.

A hydraulic tilt and trim assembly, indicated generally by the reference numeral 22 and constructed and operated in accordance with the invention is interposed between the clamping bracket 18 and the swivel bracket 16 for controlling both the trim and tilt of the motor 11. The tilt and trim unit 22 comprises a single hydraulically operated tilt cylinder assembly 23 and a pair of hydraulically operated trim cylinder assemblies 24.

The tilt cylinder assembly 23 includes a main body having a lug 25 formed at its lower end that provides a means for pivotal connection to the clamping bracket 18. The body defines a cylinder bore in which a piston 26 (FIGS. 3 and 4) is slidably supported. The piston 26 is connected to a piston rod 27 that has an eyelet 28 so as to provide a pivotal connection to the swivel bracket 16. Movement of the piston 26 within the cylinder causes the motor 12 to pivot about the pivot pin 17.

The trim cylinders 24 are each identical in construction and comprise a housing 29 in which a piston 31 (FIGS. 3 and 4) is supported for reciprocatin. Each piston 31 is affixed to a piston rod 37 that is adapted to engage the swivel bracket 16 or appropriate lugs formed upon it. The housing 29 is affixed to the clamping bracket 18 so that reciprocation of the pistons 31 causes pivotal movement of the outboard motor 12 about the pivot pin 17.

The construction as thus far described by reference to FIGS. 1 and 2 may be considered to be typical of the mechanical connection of the hydraulic assembly to the outboard drive for effecting its tilting and trim movement about the pivot pin 17. Reference will now be had primarily to the remaining figures to describe the various embodiments of the invention.

Figure 3:
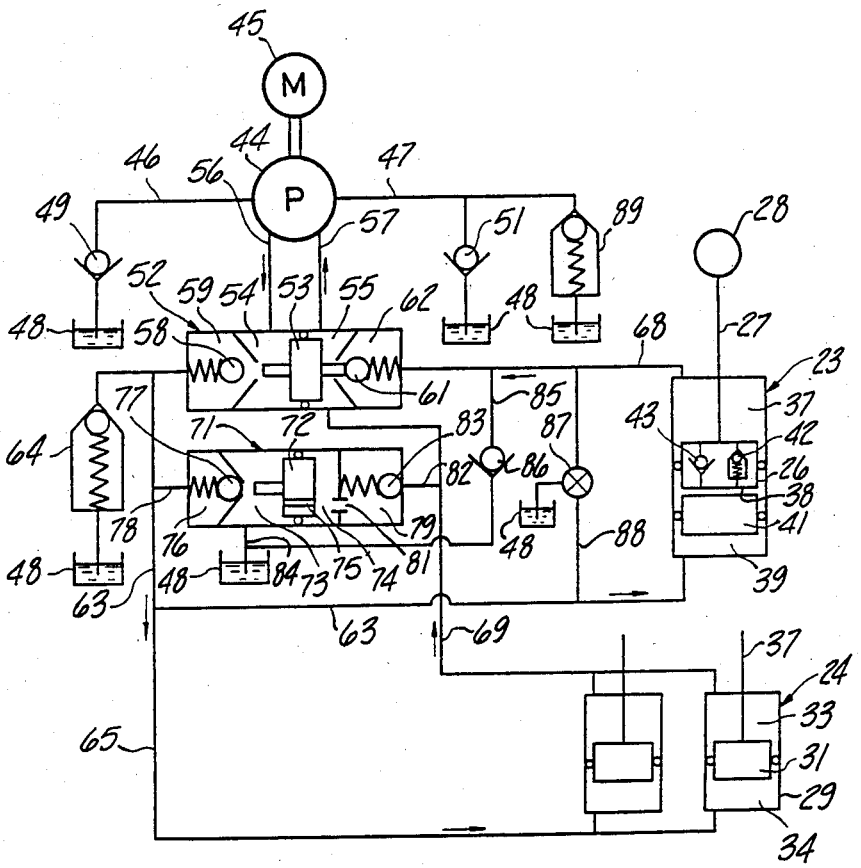
FIG. 3 is a partially schematic hydraulic circuit diagram showing the construction of a first embodiment during the tilting up mode.
Figure 4:
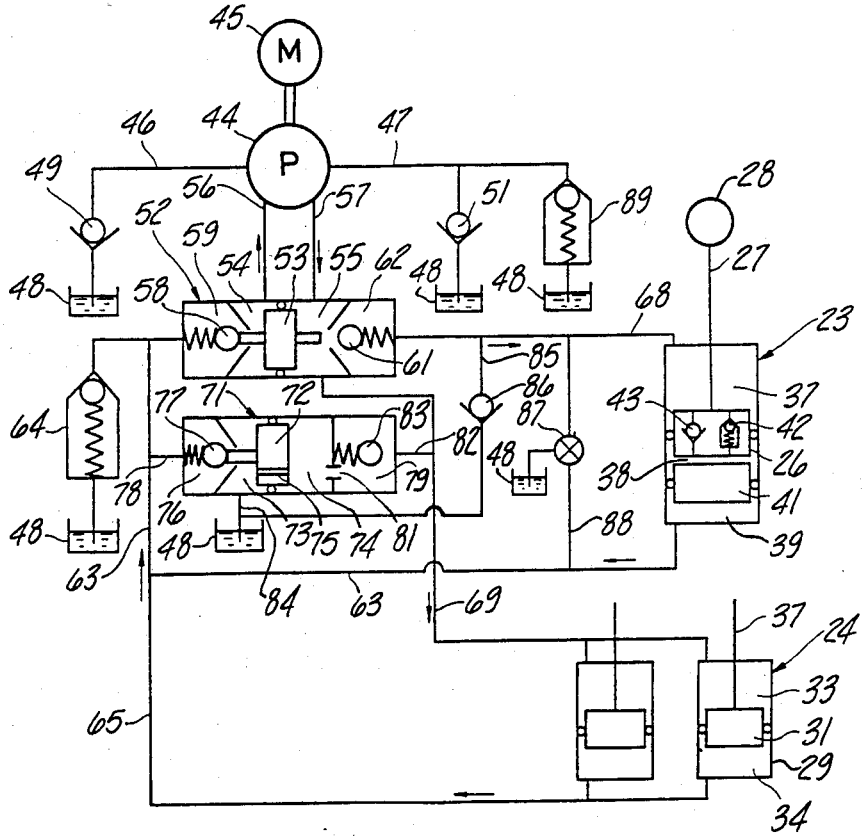
FIG. 4 is a schematic view of the embodiment shown in FIG. 3 showing the tilting down mode.

Embodiment Of FIGS. 3 and 4

The trim cylinder assemblies 24 are utlizied to provide small adjustments in the trim angle of the motor 11 relative to the transom 19. The tilt assembly 23, on the other hand, is employed for providing larger degree pivotal movements of the motor 11 so that the motor 11 may be tilted up to bring the lower unit 14 and propeller 15 out of the body of water in which the motor is being operated, as shown in the phantom line view in FIG. 1. The piston 31 of the trim cylinder assemblies 24 divides the housing 29 into an upper chamber 33 and a lower chamber 34.

The piston 26 of the tilt assembly 23 divides the cylinder into an upper chamber 37 and a lower chamber. The lower chamber itself is divided into an upper part 38 and a lower part 39 by means of a floating piston 41. The piston 41 is relatively freely floatable within the lower chamber and is operable, as will be apparent, so as to provide a further range of trim adjustment.

In addition to providing tilting action, the tilt cylinder assembly 23 provides hydraulic damping and reverse lock operation. For this purpose, a pair of passages are formed in the piston 26 for permitting flow between the upper chamber 37 and the upper portion 38 of the lower chamber. These passages are valved and include a pressure responsive absorber valve 42 of the check type that permits flow from the chamber 37 into the lower chamber upper portion 38 in response to a predetermined force tending to cause the motor 11 to tilt or pop up. The amount of the force necessary to open the valve 42 is set, as is well known, to the desired value. Return flow from the lower chamber portion 38 to the upper chamber 37 is permitted by means of a valve passage in which are return valve 43 is provided. The return valve 43 is adapted to open at a substantially lower pressure than the absorber valve 42, for example, the pressure generated by the weight of the outboard motor 11. In this way, the piston 26 may return to its normal trim condition when the force tending to pop the motor 11 up is removed, as will become apparent.

A hydraulic arrangement, shown schematically in FIGS. 3 and 4, is provided for operating the trim cylinders 24 so as to provide power up or power down trim adjustment and also so as to operate the tilt cylinder assembly 23 so as to provide power up or power down tilting operation. In addition, and as has been noted, the floating piston 41 may be adjusted by this hydraulic system so as to provide a further range of trim adjustment. The system also permits trim or tilt down operation to be accomplished at a much greater speed than tilt or trim up operation for the reasons aforenoted.

The hydraulic system includes a reversible, positive displacement pump, indicated schematically at 44, which is, in turn, driven by a reversible electronic motor 45. The pump 44 is provided with a pair of inlet lines 46 and 47 that extend from a sump 48 and in which respective non-return check valves 49, 51 are provided.

A shuttle valve assembly, indicated generally by the reference numeral 52, is provided downstream of the pump 44 and includes a shuttle piston 53 that divides the interior of the shuttle valve into first and second chambers 54 and 55. Pressurized fluid may be delivered from a first port of the pump 44 to the chamber 54 through a pressure line 56 or returned by this same line. In a like manner, the chamber 55 communicates with a second port on the opposite side of the pump 44 through a conduit 57.

A check valve 58 is provided in the chamber 54 and controls flow into a still further chamber 59. In a similar manner, a check valve 61 controls the flow from the chamber 55 into a further chamber 62. The shuttle valve 53 has outwardly extending pin projections that are adapted to engage the balls of the check valves 58 or 61 so as to open these check valves, as will become apparent.

The chamber 59 communicates with a tilt up passage 63 in which a tilt up relief valve 64 is positioned. The tilt up relief valve 64 is adpated to open at a substantially higher pressure than the check valve 58. Passage 63 extends into the chamber 39 beneath the lowermost position of the floating piston 41.

A trim up pressure line 65 branches off the tilt up pressure line 63. The passage 65 extends to the chambers 34 of the trim cylinders 24 on the underside of the trim pistons 31. Therefore, pressurization of the line 65 will cause the pistons 31 to move outwardly and cause a trim up adjustment of the motor 11.

A tilt down pressure line 68 extends from the shuttle valve chamber 62 to the chamber 37 on the upper side of the piston 26 of the tilt cylinder 23. A trim down line 69 extends from the chambers 33 of the trim pistons 24 to the chamber 55 of the shuttle valve assembly 52.

In accordance with a feature of the invention, a trim down release valve, indicated generally by the reference numeral 71, is provided. The trim down release valve 71 includes a floating piston 72 that divides the interior chamber of the housing into first and second portions 73 and 74, respectively. A small orifice 75 extends through the piston 72 and communicates the chambers 73 and 74 with each other, for a reason to be described.

The chamber 73 is adapted to communicate with a chamber 76 through a pressure responsive check valve 77 that is disposed so as to permit flow from the chamber 73 to the chamber 76 but not flow in a reverse direction. The chamber 76 communicates with the line 63 through a line 78. The piston 72 has a projection that is adapted to engage and unseat the ball of check valve 77 under certain conditions, to be described.

The chamber 74 communicates with a further chamber 79 at the opposite side of the tilt down release valve 71 through a restricted opening 81. The chamber 79, in turn, communicates with the line 69 through a line 82 and check valve 83. The check value 83 is disposed so as to preclude flow from the chamber 79 into the line 82 while permitting flow in the opposite direction.

A line 84 communicates the tilt down release valve chamber 73 with the sump 48. In addition, a line 85 in which a check valve 86 is provided communicates the line 84 with the tilt down line 68. The check valve 86 is disposed so as to permit flow from the line 85 into the line 68 while precluding flow in a reverse direction.

To permit manual tilting of the motor 11, a manually operated valve 87 is positioned in a conduit 88 that extends between the conduits 63 and 68 and which also controls communication with the sump 48.

FIG. 3 shows the condition of the mechanism during the tilt or trim up mode. Assuming that the motor 11 is at a normal running positions and that the manual valve 81 is closed, if the operator desires to tilt the motor 11 up, through a suitable control, he operates the motor 45 so as to drive the pump 44 in a direction wherein the line 56 is pressurized and the line 57 acts as a return line. When the line 56 is pressurized, the pressure in the chamber 54 will exceed the pressure in the chamber 55 and the shuttle piston 53 of the shuttle valve assembly 52 will be forced to the right from its previous neutral position. When the shuttle piston 53 is shifted to the right, its projection will unseat the ball check valve 61 and open communication between the shuttle valve chambers 55 and 62.

Pressurization of the chamber 54 causes the ball check valve 58 to open. As has been previously noted, the check valve 58 opens at a substantially lesser pressure than the relief valve 64. Therefore, the line 63 will be pressurized so that pressure will be generated in the chamber 39 below the floating piston 41 so as to urge the piston 41 upwardly against the piston 26.

When the line 63 is pressurized, this pressure will also be transmitted to the line 65 and the chambers 29 of the underside of the pistons 31 of the trim adjusting cylinders 24 will be pessurized and the pistons 31 will move upwardly.

Fluid may be expelled from the chamber 37 on the upper side of the piston 26 so as to permit the outboard motor 11 to be tilted up. This fluid is driven through the line 68 into the shuttle valve chamber 62. Since the check valve 61 is held open, this fluid may pass through into the chamber 55 and be returned to line 57, which now acts as a return line.

Upward movements of the pistons 31 of the trim cylinder assemblies 24 will cause fluid to be driven from the upper chambers 33 into the line 69. This pressure is not sufficient to open the check valve 83 of the tilt down release valve assembly 71 and the fluid will be returned through the shuttle valve chamber 55 to the line 57.

It should also be noted that during this operation, the pressure in the line 78 enters the tilt down release valve chamber 76 and acts on the ball check valve 77 to hold it in a closed position.

The tilt or trim down operation will now be described by reference to FIG. 4. Assuming that the motor 11 is in a tilted up condition, the piston 26 and floating piston 41 will be displaced toward the upper end of the cylinder 23. If the operator determines to tilt the motor down, the electric motor 45 is energized so as to drive the pump 44 in a direction to pressurize the line 57 and cause the line 56 to function as a pump return line.

When the line 57 is pressurized, the pressure in the chamber 55 of the shuttle valve assembly 52 will shift the shuttle piston 53 to the left to unseat the ball check valve 58. The pressure in the chamber 55 is sufficient to unseat the check valve 61 so as to communicate the chambers 55 and 62 with each other. Therefore, the line 68 will be pressurized and pressure will be exerted in the chamber 37 above the piston 26. The piston 26 and, accordingly, the floating piston 41 will be forced downwardly and the motor 11 will tilt down.

Pressurization of the chamber 55 will also cause the line 69 to become pressurized so as to exert fluid pressure from the pump 44 in the chambers 33 on the upper side of the trim pistons 31. At the same time, this pressure will be exerted through the line 82 on the ball check valve 83. This check valve opens at a lower pressure than the check valve 61 of the shuttle valve assembly 52 and, therefore, the tilt down release valve chamber 79 will be pressurized before the chamber 62 of the shuttle valve assembly 52 becomes pressurized. Pressurization of the chamber 79 is transmitted through the opening 81 of the chamber 74 to urge the shuttle piston 72 to the left to unseat the ball check valve 77.

When the ball check valve 77 is opened, the chamber 76 which communicates with the lines 63 and 65 will be opened to communicate with the chamber 73 and the line 84. Hence, fluid expelled from the tilt cylinder chamber 39 and the trim cylinder chambers 34 need not flow back through the line 56 to the pump 44 but can be immediately returned to the sump 48 through the line 84. As a result of this, the motor 11 may be tilted down much more rapidly than with prior art type of constructions that required all of the displaced fluid to flow back through the pump 44.

When the operation of the motor 45 is stoped, the pressure in the shuttle valve chamber 55 will decrease and the check valve 61 will immediately close. However, the weight of the motor or its forward driving thrust may still be utilized to effect further tilt or trim down operation since the shuttle piston 72 of the tilt down cutoff valve assembly 71 will be restrained from moving back to its normal position by the slow flow which will occur through its restricted opening 75.

Hence, furhter fluid may be displaced from the lower chamber 39 of the tilt cylinder assembly 23 and the lower chambers 34 of the trim cylinders 24. This fluid can flow back through the line 85 and open check valve 86 to the area above the tilt cylinder piston 26 so as to prevent the drawing of a vacuum in this area and so as to further assist in the downward movement.

A tilt down pressure relief valve 89 communicates with the line 47 and will permit flow back to the sump 48 in the event the floating piston 41 and tilt piston 26 reach the bottom of their stroke and the operation of the pump 44 has not been stopped.

As has been previously noted, the construction of the tilt cylinder 23 is such that it will absorb reverse thrust and also will permit the motor 11 to pop up under conditions when an obstacle is struck underwater. When the floating piston 41 is in a trimmed up condition and the motor is operated in reverse, the piston 26 will tend to be drawn upwardly in the cylinder 23. However, the pressure responsive absorber valve 42 will be held closed under normal reverse running conditions and the motor 11 will not be permitted to pop up.

If an underwater obstacle is struck, however, sufficient force can be exerted as to cause the absorber valve 42 to open and permit the motor to pop up. Once the underwater obstacle is cleared, the weight of the motor acting on the piston 26 will be sufficient so as to cause the return valve 43 to open and permit the piston 26 to move downwardly until it again contacts the floating piston 41 and will then be held in the trimmed up condition.

Figure 5:
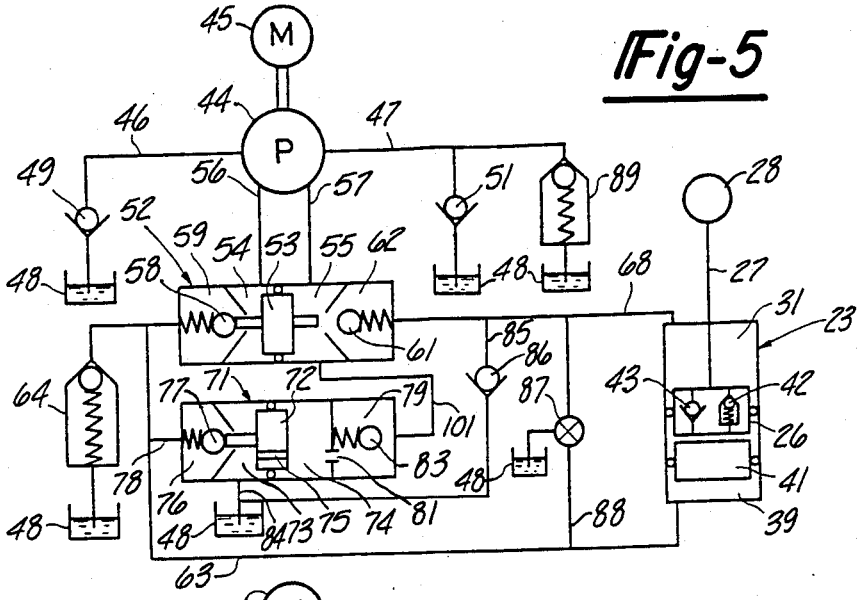
FIG. 5 is a schematic view, in part similar to FIGS. 3 and 4, but showing a different embodiment.

Embodiment of FIG. 5

FIG. 5 illustrates an embodiment that is substantially the same as the embodiment of FIGS. 3 and 4 but which completely eliminates that use of the trim cylinders 24. This may be done because the floating piston 41 of the tilt cylinder assembly 23 can be employed to perform the trim adjustment position as previously noted. Except for the elimination of the trim cylinders and the circuitry associated with them, this embodiment is the same as the embodiment previously described and for that reason components which are the same have been identified by the same reference numeral and will not be described again in detail. Since the trim cylinders have been deleted, the tilt down cutout valve assembly 71 is operated by means of a conduit 101 that extends from the shuttle valve chamber 55 to the check valve 83. Thus, it is believed that the operation of this device should be readily apparent and reference may be had to the description of the embodiments of FIGS. 3 and 4 for the operation of this embodiment.

Figure 6:
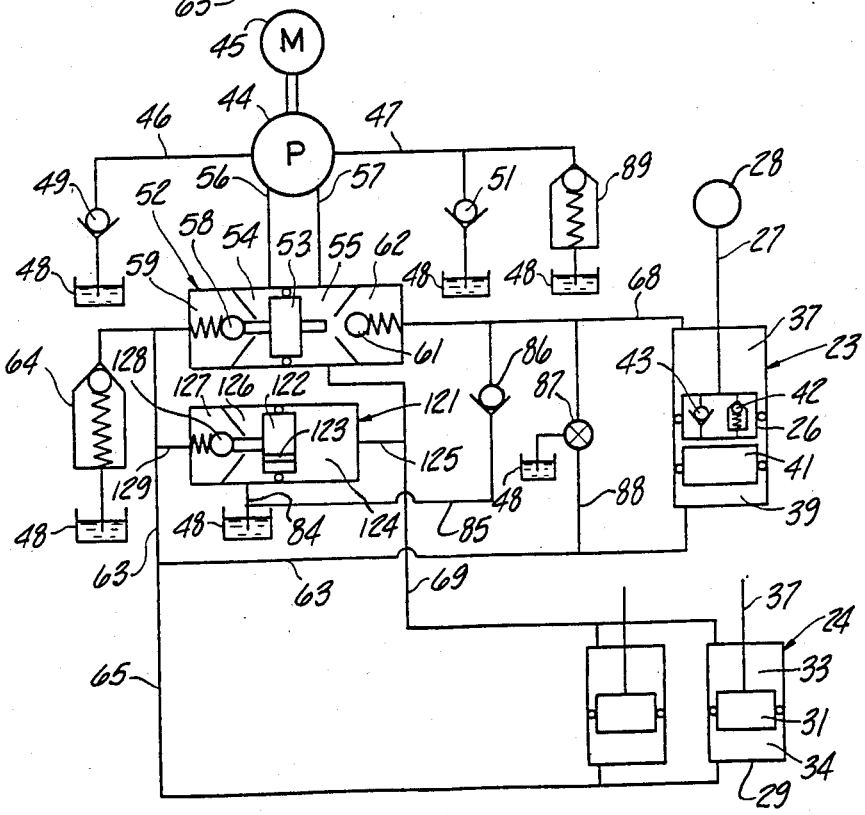
FIG. 6 is a schematic view, in part similar to FIGS. 3 and 5, showing a further embodiment of the invention.

Embodiment of FIG. 6

In the embodiment of FIGS. 3 and 4, the tilt down release valve assembly 71 embodied a check value 83 that cooperated with the shuttle piston 72 to provide a time delay in closure of the return line so as to permit continued tilt down movement after the pump 44 had ceased its operation. The embodiment of FIG. 6 uses a somewhat different tilt down shutoff valve assembly that will provide quicker shutoff response once the motor 45 and pump 44 are shut off on the tilt down mode. In all other regard, this embodiment is the same as the embodiment of FIGS. 3 and 4 and, for that reason, the same components have been illustrated by the same reference numerals and their description will be repeated only insofar as is necessary to understand the construction and operation of this embodiment.

In this embodiment, a tilt down release valve assembly is identified generally by the reference numeral 121. It includes a floating piston 112 in which a restricted opening 123 is provided. The piston 122 divides the housing into a first chamber 124 that communicates directly with the line 69 through a line 125. That is, the check valve 83 employed in the previous embodiments is not utilized in this embodiment.

A chamber 126 is formed on the other side of the shuttle piston 122 and communicates with a chamber 127 through a check valve 128. The check valve 128 is normally biased so as to prevent flow from the chamber 127 into the chamber 126 but so as to permit flow in the opposite direction. The chamber 127 communicates with the line 63 through a line 129.

This embodiment operates like the embodiment of FIG. 3 and 4 during the tilt and trim up operation and, for that reason, the description of these operations will not be repeated.

Considering now the tilt down or trim down mode, when the pump 44 is operated so as to pressurize the line 57, the other components of the device will operate as described in connection with the embodiment of FIGS. 3 and 4. However, in this embodiment, the chamber 124 will be immediately pressurized through the line 125 and the shuttle piston 122 will be immediately forced to the left to open the check valve 128 and permit return communication of fluid from the piston chambers 39 and 34 to the reservoir 48 through the line 84. Immediately upon discontinuance of the operation of the pump 44, the weight of the outboard motor will place e loan on the piston 26 and pistons 31, if it has been lowered sufficiently, so as to tend to pressurize the chambers 39 and 29 and drive fluid back through the valve 128. However, this will tend to cause a vacuum to be drawn in the chamber 33 and 37 which will be transmitted back through the line 69 to the chamber 124 of the tilt down cutoff valve assembly 121 so as to draw the piston 122 to the right and close the check valve 128 so as to immediately halt downward movement. Thus, this device will operate to provide the fast tilt down operation of the embodiment of FIGS. 3 and 4 but will cut off this operation rapidly once the motor 45 is stopped.

Figure 7:
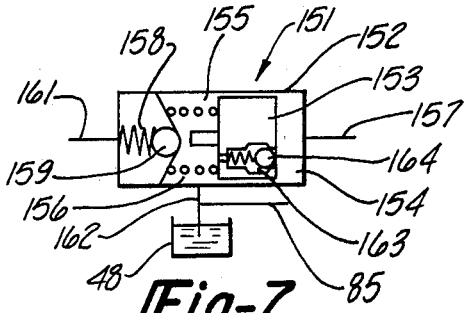
FIG. 7 shows another embodiment of a tilt down release valve that may be used with any of the previous embodiments and shows the condition during tilting up operation.
Figure 8:
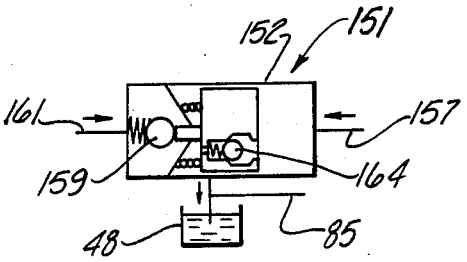
FIG. 8 is a view, in part similar to FIG. 7, showing the tilting down operation.
Figure 9:
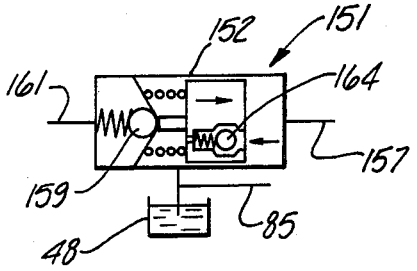
FIG. 9 is a view, in part similar to FIG. 8, and shows the operation immediately upon cessation of the tilting down operation.

Embodiment of FIGS. 7 Through 9

In FIGS. 7 through 9, a further type of tilt down release valve assembly is identified generally by the reference numeral 151. Only the release valve assembly 151 has been illustrated in detail since it may be used in combination with the circuits of any of the previously described embodiments.

In the previously described embodiments, there is a time delay during the tilt down operation due to the use of the restricted passageways in the shuttle pistons 72 or 122 of the respective tilt down cutoff valve assemblies 71 or 121. The cutoff valve assembly 151 is designed so as to provide a quicker operation and also so as to insure that the device can be readily adjusted without significant hunting.

The tilt down release valve assembly 151 includes a housing 152 in which a shuttle piston 153 is slidably supported. The shuttle piston 153 divides the housing 152 into a first chamber 154 and a second chamber 155. A spring 156 is positioned in the chamber 155 so as to urge the shuttle piston 153 to the right as seen in the figures.

As with the previously described embodiments, the chamber 154 is exposed to the pump pressure in the line 57 via the shuttle valve assembly 59 through a conduit 157.

A third chamber 158 is separated from the second chambre 155 by a check valve assembly 159. The chamber 158 is exposed to the pressure in the line 63 by means of a line 161.

As also with the previously described embodiments, the chamber 155 is adapted to communicate with either the sump 48 or a line 85 through a line 162.

The shuttle piston 153 is formed with a through passage 163 in which a check valve 164 is positioned. The check valve 164 is biased so as to releasably prevent flow from the chamber 154 to the chamber 155 while preventing flow in the reverse direction.

FIG. 7 shows the operation during tilt up operation. In this condition, the line 161 is pressurized while the line 157 is exposed to sump or return pressure and the shuttle piston 153 will be held to the right and the check valve 159 closed.

FIG. 8 shows the operation during a tilt down mode. In this condition, the line 157 is pressurized and the shuttle piston 153 will be urged to the left. Simultaneously and prior to the movement, the ball 164 will be urged to the left and engage another seat at the opposite side to close the passage 163. The spring 156 will be compressed and the ball check valve 159 will immediately be opened so as to permit return flow in the manner as previously described.

FIG. 9 shows the condition immediately upon cessation of operation of the pump 44. The pressure in the chamber 154 will decrease and the spring 156 will urge the piston 153 to the right. As the same time, the spring will urge the ball check valve 164 to the right but it will not fully close because of the fluid trapped within the chambr 154 which can then flow through the open passage 163 to the chamber 155 so as to speed up closure of the check valve 159 and insure rapid stopping of the downward movement.

It should be readily apparent from the foregoing description that a number of embodiments of the invention have been described which permits controlled tilt or trim up operation and which permits tilt or trim down operation at a high speed and independent of the speed of the tilt up operation. This is achieved in all embodiments by permitting the reverse flow from the operating cylinders be they the tilt and/or trim cylinders back either to the reservoir or the other side of the pistons without having to flow through the actuating fluid pump. As a result, tilt down operation is independent of the tilt up speed.

Although a number of modifications and embodiments have been illustrated and described, various changes and modifications may be made, without departing from the spirit and scope of the invention, as defined by the appended claims.

I claim:

1. In a hydraulic tilt and trim unit for a marine outboard drive pivotal about a generally horizontal axis between a tilted up position and a tilted down position comprising a double acting fluid motor operatively connected between said outboard drive and the associated watercraft for pivotal movement of said outboard drive about said horizontal axis upon operation of said fluid motor, a reversible pump having a first port operative as a suction port when said fluid pump is operated in a forward direction and was a pressure port when said fluid pump is operated in a reverse direction and a second port operative as a pressure port when said fluid pump is operated in the forward direction and as a suction port when the fluid pump is operated in the reverse direction, and conduit means for delivering fluid from said first port to drive said fluid motor in a lifting direction when said fluid pump is operated in its reverse direction for effecting pivotal movement of said outboard drive toward its tilted up position and for delivering fluid from said second port when said fluid pump is operated in its forward direction to drive said fluid motor in its lowering direction to effect pivotal movement of said outboard drive toward its tilted down position, the improvement comprising means for discharging fluid from said fluid motor when operated by said pump in its lowering direction without having to flow through the first fluid pump port.

2. In a hydraulic tilt and trim unit as set forth in claim 1 wherein the means for discharging fluid from the fluid motor returns fluid to a reservior.

3. In a hydraulic tilt and trim unit as set forth in claim 1 wherein the means for discharging fluid from the fluid motor of the first fluid pump port delivers fluid to the other side of the fluid motor.

4. In a hydraulic tilt and trim unit as set forth in claim 3 wherein the means for discharging fluid from the fluid motor returns fluid to a reservoir.

5. In a hydraulic tilt and trim unit as set forth in claim 1 wherein the means for discharging the fluid of the first fluid pump port comprises a pressure responsive valve.

6. In a hydraulic tilt and trim unit as set forth in claim 5 wherein the pressure responsive valve includes time delay means for delaying the movement of said valve from an open position to a closed position in response to the removal of the activating pressure.

7. In a hydraulic tilt and trim unit as set forth in claim 5 wherein the pressure acting on the pressure responsive valve is the pressure exerted on the fluid motor.

8. In a hydraulic tilt and trim unit as set forth in claim 5 wherein the pressure acting on the pressure responsive valve is the pressure at the second port of the fluid pump.

9. In a hydraulic tilt and trim unit as set forth in claim 1 wherein the double acting fluid motor compries a tilt motor for driving the outboard drive between its tilted down and its tilted up position and further including trim cylinder means operative between the watercraft and outboard drive for pivoting the outboard drive about the horizontal axis between a plurality of trim adjusted positions, the conduit means being operative to provide fluid under pressure from the first port to one side of the trim cylinder for trim up adjustment of the outboard motor when the fluid pump is operated in the forward direction and to the opposite side of the trim cylinder means for trim down adjustment when the fluid pump is operated in the reverse direction, the discharge means for discharging the fluid being operative to further independently discharge the fluid from the trim cylinder means independently of the first fluid pump port.

10. In a hydraulic tilt and trim unit as set forth in claim 1 wherein the means for discharging fluid from the fluid motor of the first fluid pump port comprises a tilt down release valve assembly comprising a housing having a first chamber, a second chamber and a third chamber, said second and third chambers being separated from each other by a shuttle piston, check valve means for permitting flow from said second chamber to said first chamber and biased to preclude flow from said first chamber to said second chamber, said first chamber being in communication with said first fluid pump port, said third chamber being in communication with said second fluid pump port for urging said shuttle piston toward said first chamber when said fluid pump is operated in the forward direction and said second fluid pump port is pressurized, said shuttle piston having means thereon for opening said check valve when said shuttle piston is urged toward said first chamber, and means for communicating said second chamber with a return fluid path.

11. In a hydraulic tilt and trim unit as set forth in claim 10 wherein the means for communicating and second fluid chamber with the return path communicates with a reservior.

12. In a hydraulic tilt and trim unit as set forth in claim 10 wherein the means for communicating the second fluid chamber with the return fluid path delivers fluid to the non-pressurized side of the double acting fluid motor.

13. In a hydraulic tilt and trim unit as set forth in claim 12 wherein the means for communicating the second fluid chamber with the return fluid path further commincates with a reservoir.

14. In a hydraulic tilt and trim unit as set forth in claim 10 further including wall means interposed in the third fluid chamber and dividing the third fluid chamber into a first part in which the shuttle piston is received and a second part that communicates with the second fluid port via check valve means.

15. In a hydraulic tilt and trim unit as set forth in claim 14 further including a restricted passageway extending through the shuttle piston and communicating the second and third fluid chambers with each other at a restricted rate for a time delay return of said shuttle piston when the second fluid port is not pressurized.

16. In a hydraulic tilt and trim unit as set forth in claim 10 wherein the shuttle piston has a passage extending therethrough and further including check valve means for controlling the flow through said passage.

17. In a hydraylic tilt and trim unit as set forth in claim 16 wherein the check valve menas is normally biased to a position to preclude flow from the third fluid chamber to the second fluid chamber until the pressure in the third fluid chamber exceeds the pressure in the second fluid chamber by a predetermined amount and further precludes flow from the third fluid chamber to the second fluid chamber when there is more than a predetermined pressure differential between the pressure in said chambers.

* * * * *